US008409362B2

(12) United States Patent
Elick et al.

(10) Patent No.: US 8,409,362 B2
(45) Date of Patent: Apr. 2, 2013

(54) SYSTEM AND METHOD FOR LOW TEMPERATURE HYDRATION OF FOOD SOILS

(75) Inventors: Robert Alan Elick, Jackson, TN (US); Rodney M. Welch, Beech Bluff, TN (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 13/150,294

(22) Filed: Jun. 1, 2011

(65) Prior Publication Data

US 2011/0226287 A1 Sep. 22, 2011

Related U.S. Application Data

(63) Continuation of application No. 12/248,153, filed on Oct. 9, 2008, now Pat. No. 7,988,789.

(51) Int. Cl.
*B08B 3/04* (2006.01)

(52) U.S. Cl. ..... 134/25.2; 134/18; 134/56 D; 134/58 D; 134/184

(58) Field of Classification Search ..... 134/18, 134/25.2, 25.3, 31, 56 D, 58 D, 184
See application file for complete search history.

(56) References Cited

U.S. PATENT DOCUMENTS

| | | | | |
|---|---|---|---|---|
| 7,988,789 | B2 * | 8/2011 | Elick et al. | 134/25.2 |
| 2004/0040586 | A1 * | 3/2004 | Kumar | 134/26 |
| 2005/0224098 | A1 * | 10/2005 | Fujii et al. | 134/26 |
| 2006/0042658 | A1 * | 3/2006 | Engler | 134/18 |
| 2010/0089425 | A1 * | 4/2010 | Classen et al. | 134/25.2 |

* cited by examiner

*Primary Examiner* — Saeed T Chaudhry
(74) *Attorney, Agent, or Firm* — Jacquelyn R. Lin; Diederiks & Whitelaw PLC

(57) ABSTRACT

A system and method for low temperature hydration of food soils allows for hydration of food soils between washing cycles in a dishwasher. A user selects a hydration button to actuate a hydration cycle between dishwashing cycles. During the hydration cycle, a plurality of spraying devices are periodically actuated in accordance with a desired amount of hydration selected by the user. Water is supplied from a dedicated water supply line to the spraying devices, preferably without being heated, and is distributed throughout a dishwasher chamber utilizing spray nozzles or fans. The hydration cycle ends when deactivated, or when a dishwashing cycle is initiated.

20 Claims, 5 Drawing Sheets

SYSTEM AND METHOD FOR LOW TEMPERATURE HYDRATION OF FOOD SOILS

CROSS-REFERENCE TO RELATED APPLICATION

This application is a continuation of pending U.S. patent application Ser. No. 12/248,153, filed Oct. 9, 2008.

BACKGROUND OF THE INVENTION

1. Field of the Invention

The present invention pertains to the art of dishwashers and, more specifically, to a system and method for the hydration of food soils in a dishwasher.

2. Description of the Related Art

Although it is advisable to thoroughly rinse dirty dishes prior to loading the dishes into a dishwasher for a future washing operation, it is not uncommon to find that many dishes are loaded into dishwashers with food remnants still on, for example, plates. At least in situations wherein a washing cycle is not initiated in short order, the food remains can dry and harden, thereby preventing the dishes from getting fully cleaned during a later washing cycle. To counter this problem, it is known in the art to apply an atomized heated detergent solution to dishware as a first step in a dishwashing cycle, as demonstrated by U.S. Patent Application Publication No. 2005/0224098. Such methods require that a liquid reservoir be filled before atomizing can occur. Further, the energy required to heat dishwashing fluid is significant. In general, heat is necessary during the dishwashing process for softening greases and oils and for activating the chemistry of dishwashing detergents. However, heat can polymerize some food soils, such as egg, making the food soil even more difficult to remove during a washing cycle.

It has also been proposed in the art to employ steam as a pretreatment in an attempt to soften food residue for a dishwashing operation. However, like the other known prior art discussed above, steam requires a lot of energy to generate and can correspondingly also polymerize some foods. Based on the above, there is considered to be a need in the art for a dishwasher system and method that aids in the removal of food soils from dishware without the need for reservoirs of heated washing solution and which can be advantageously employed even when a significant amount of time elapses between the loading of soiled dishware and the activation of a washing cycle.

SUMMARY OF THE INVENTION

The present invention is directed to a system and method for the low temperature hydration of food soils between washing cycles in a dishwasher. The dishwasher includes a tub defining a washing chamber in which soiled dishware may be placed. When pre-hydration of the dishware is desired, a user selects a hydration button on the dishwasher control panel to actuate a hydration cycle. During the hydration cycle, a plurality of atomizers, such as ultrasonic atomizers, are periodically actuated in accordance with a desired amount of hydration selected by the user. Water is supplied from a dedicated water supply line to the atomizers without being heated, and is distributed throughout a dishwasher chamber utilizing nozzles or fans associated with the atomizers. A draining event may be performed when water reaches a predetermined level within the dishwasher or after a predetermined point in the hydration cycle. The hydration cycle ends when deactivated by a user, after a predetermined period of time, or upon actuation of a dishwashing cycle. Pre-hydrating food soils before a dishwashing event prevents food soils from becoming dried to dishware, and washing efficiency of the dishwasher is improved. Further, by providing a means for hydrating food soils with small amounts of low temperature water, polymerization of food soils such as eggs is prevented and energy and water consumption is reduced.

Based on the above, the present invention essentially establishes a long presoak period wherein low temperature hydration of food soils occurs. With this arrangement, when the actual washing operation for the dishwasher cycle starts, the food soils have already been softened. To this end, the invention provides a more effective cleaning that can be done with even baked-on food soils using lighter duty, shorter cycles with less water. Therefore, the invention provides for a more effective overall cleaning process, while representing an overall savings in water and energy. Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF PREFERRED EMBODIMENTS

Figure 1:
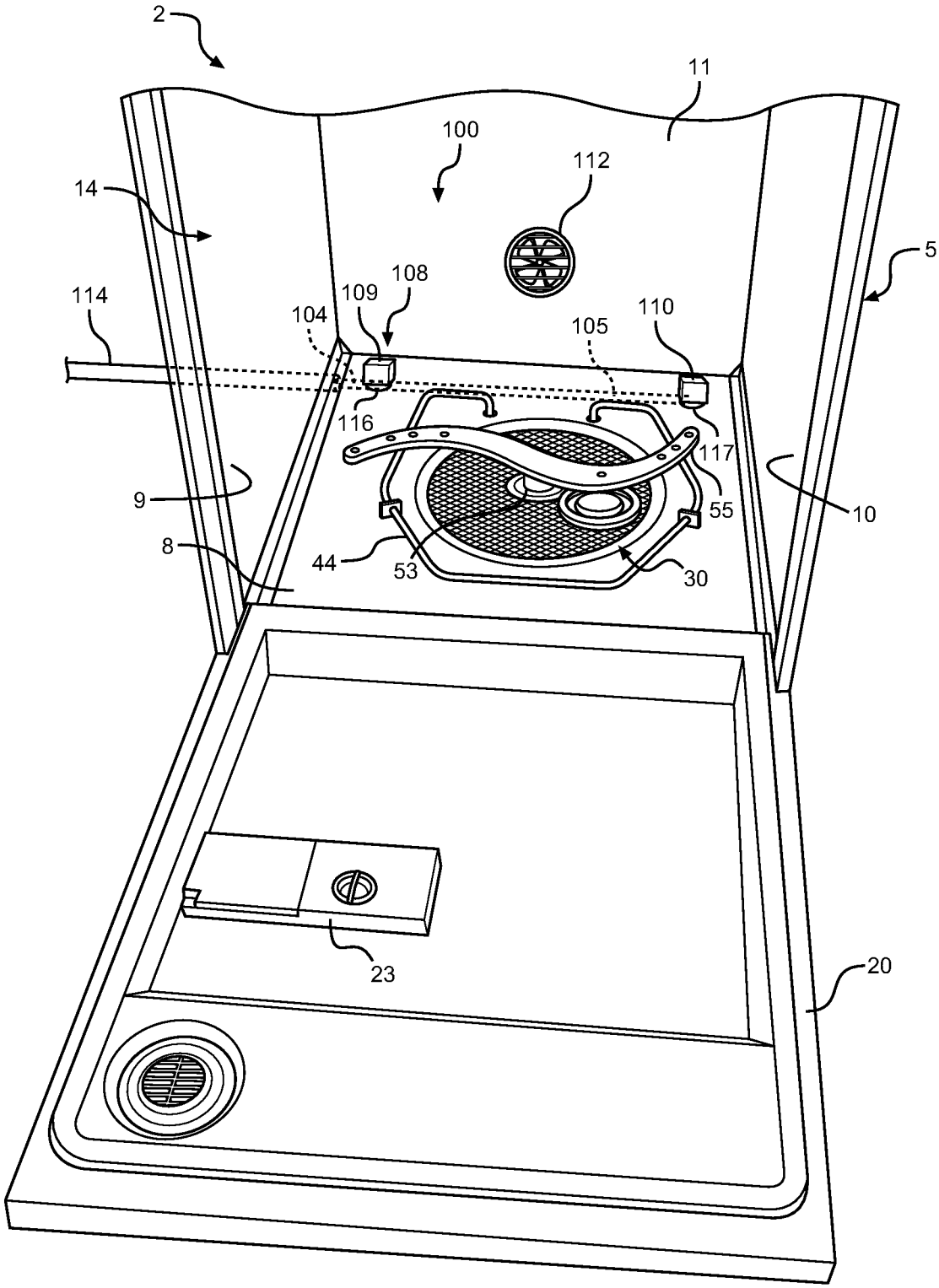
FIG. 1 is a partial perspective view of the inside of a dishwasher including a food soil hydration system constructed in accordance with a first embodiment of the present invention.

With initial reference to FIG. 1, a dishwasher constructed in accordance with the present invention as generally indicated at 2. As shown, dishwasher 2 includes a tub 5 which is preferably molded of plastic so as to include integral bottom, side and rear walls 8-11 respectively, as well as a top wall (not shown). Tub 5 defines a washing chamber 14 within which soiled kitchenware or other soiled products are adapted to be placed upon shiftable upper and lower racks (not shown for drawing clarity), with the kitchenware being cleaned during a washing operation. Tub 5 has attached thereto a pivotally supported door 20 used to seal chamber 14 during the washing operation. In connection with the washing operation, door 20 is preferably provided with a detergent tray assembly 23 within which a consumer can place liquid or particulate washing detergent for dispensing at predetermined portions of the washing operation. Of course, dispensing detergent in this fashion is known in the art such that this arrangement is only being described for the sake of completeness.

Disposed within tub 5 is a filtration system generally indicated at 30. Extending about a substantial portion of filtration system 30, at a position raised above bottom wall 8, is a heating element 44. In a manner known in the art, heating element 44 preferably takes the form of a sheath, electric resistance-type heating element.

Dishwasher 2 further includes a fluid distribution system including a circulation pump (not shown) adapted to direct washing fluid from a sump (not shown) to a wash fluid distribution manifold indicated at 53 in a manner known in the art. Wash fluid distribution manifold 53 in turn supplies washing fluid to a fluid response rotatable drive spray arm 55. Basically, the above description of dishwasher 2 has been provided for the sake of completeness as the present invention is particularly directed to a food soil hydration system 100 and method for hydrating food soils on dishware products between washing cycles, as will now be discussed in more detail below.

In general, food soil hydration system 100 of the present invention includes dedicated water supply lines 104, 105 for supplying water to a plurality of atomizing devices 108. In the embodiment shown in FIG. 1, atomizing devices 108 constitute first and second ultrasonic vibrators 109 and 110 positioned adjacent respective side walls 9 and 10 and rear wall 11 of tub 5. Also included as part of food soil hydration system 100 is a fan 112 which is preferably utilized to aid in distributing atomized water throughout washing chamber 14.

In use, a main water supply line 114 for dishwasher 2 also supplies water to dedicated water supply lines 104 and 105. Control valves 116 and 117 control the flow of water from dedicated water supply lines 104 and 105 to respective atomizing devices 109 and 110. In a preferred embodiment, the pressure required to force water through dedicated water supply lines 104, 105 and atomizing devices 109, 110 is provided by water pressure from main water supply line 114. With this configuration, only a small amount of water necessary for a pre-hydration event is supplied to atomizing devices 109 and 110 without the need for any pumps or other equipment. Specific details of the operation of food soil hydration system 100 will be provided herein, after discussing additional embodiments for carrying out the invention.

Figure 2:
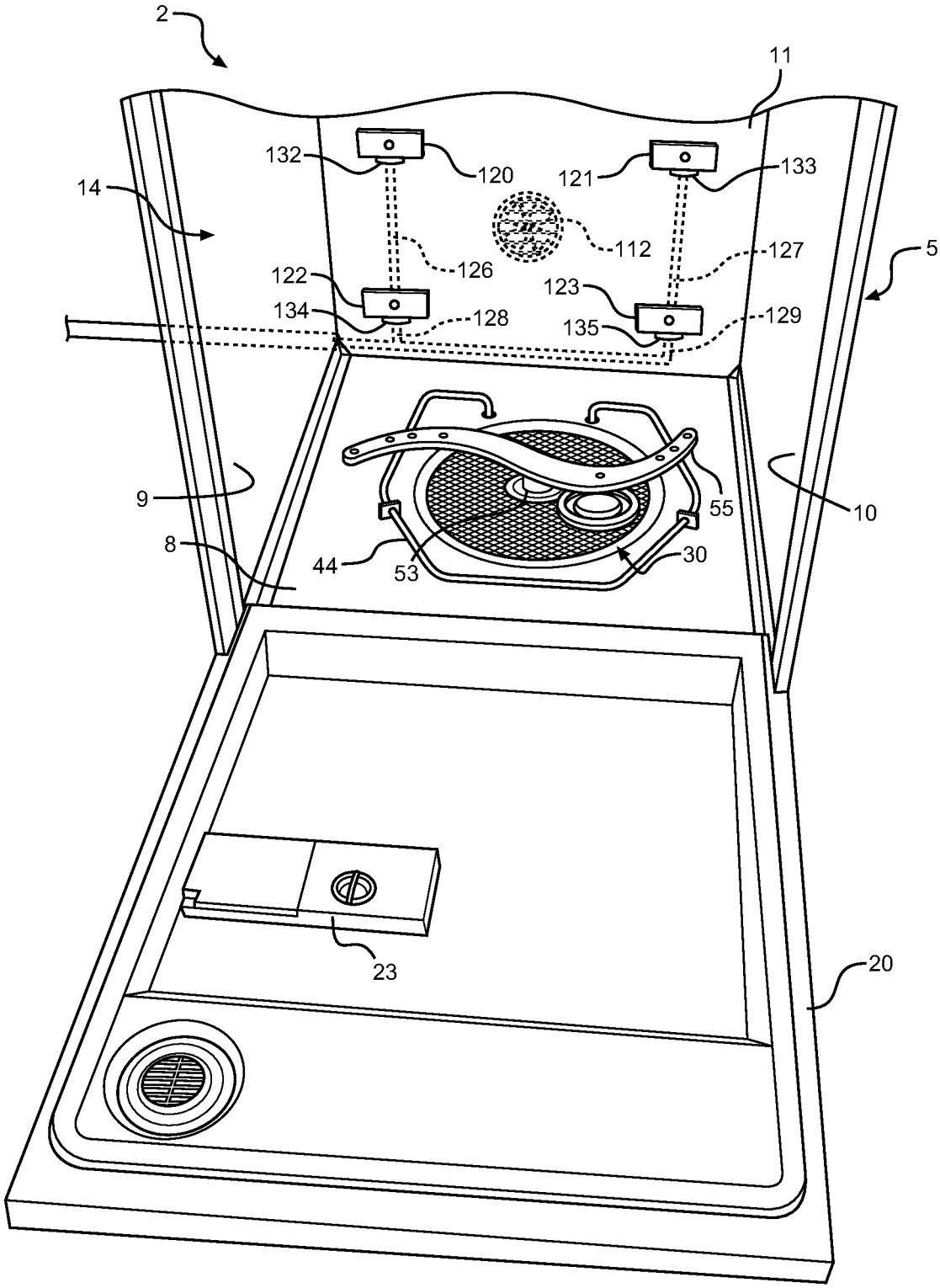
FIG. 2 is a partial perspective view of the inside of a dishwasher including a second embodiment of the food soil hydration system of the present invention.

In a second embodiment depicted in FIG. 2, first, second, third and fourth wall-mounted atomizing nozzles 120-123 are utilized to direct atomized water to upper and lower portions of washing chamber 14. Although fan 112 may be utilized with this configuration, atomizing nozzles 120-123 are preferably configured to propel atomized water throughout washing chamber 14, thereby eliminating the need for fan 112. Similar to ultrasonic vibrators 109 and 110, dedicated water supply lines 126-129 and valves 132-135 regulate the supply of water to atomizing nozzles 120-123.

Figure 3:
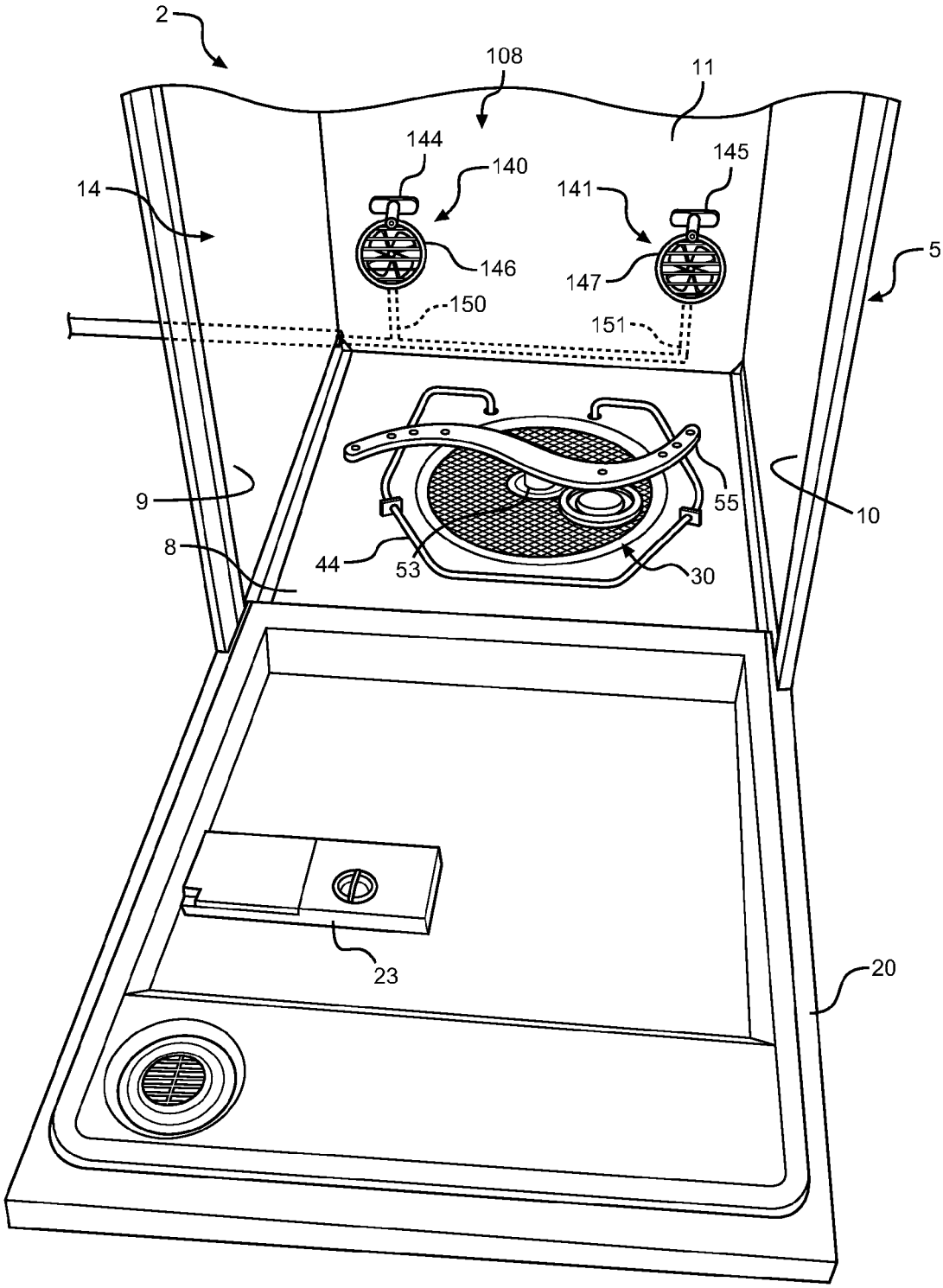
FIG. 3 is a partial perspective view of the inside of a dishwasher including a third embodiment of the food soil hydration system of the present invention.

In a third embodiment depicted in FIG. 3, atomizing devices 108 are in the form of first and second spray nozzle arrays 140 and 141. Each of first and second spray nozzle arrays 140 and 141 includes a respective spray nozzle 144, 145 and atomizing fan 146, 147. In use, water is supplied to spray nozzles 144 and 145 via respective dedicated water supply lines 150 and 151. Water sprayed by spray nozzles 144 and 145 is directed to respective atomizing fans 146 and 147 and is atomized and distributed throughout washing chamber 14 by atomizing fans 146 and 147.

Figure 4:
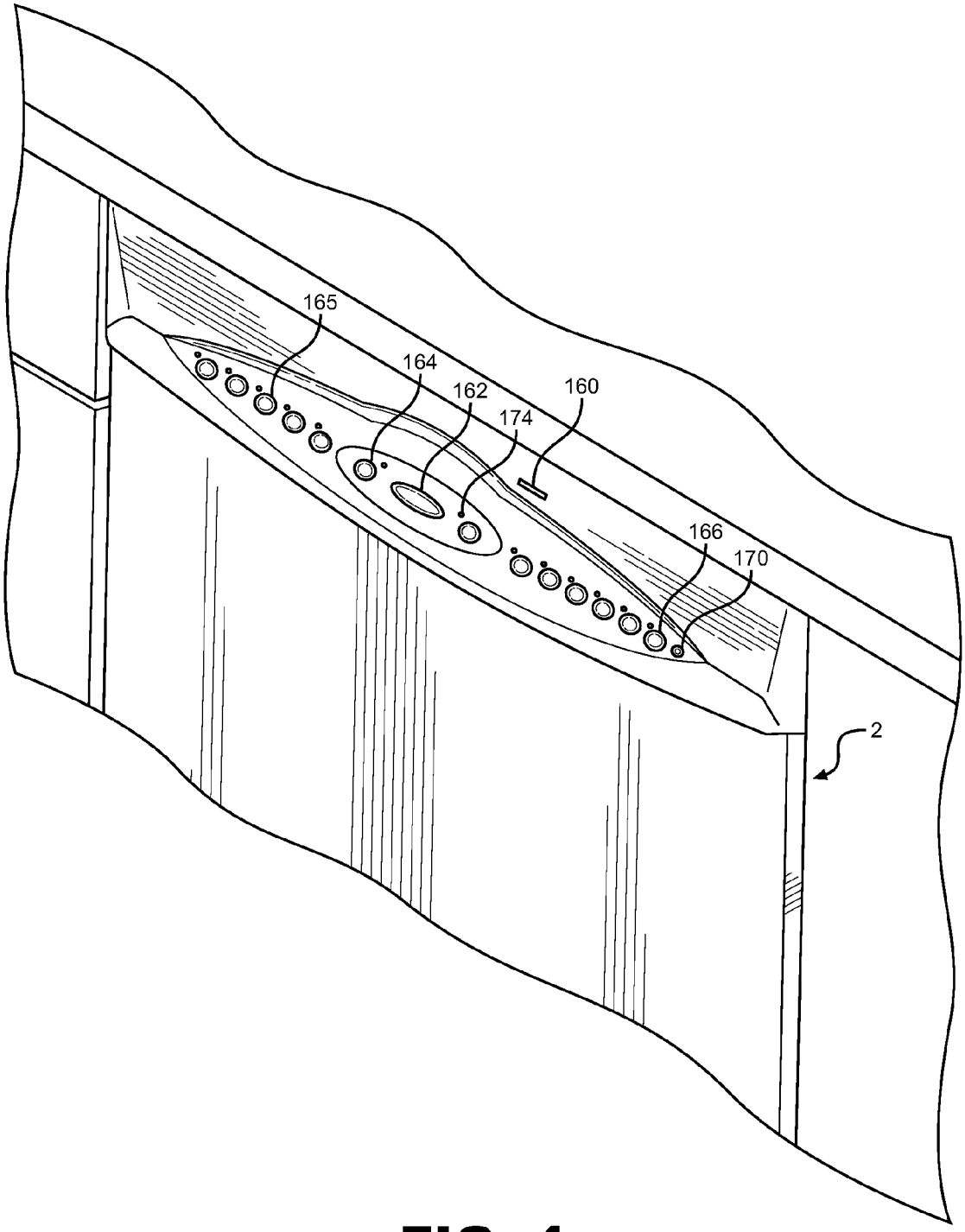
FIG. 4 is a partial front view of a dishwasher including a control panel in accordance with the present invention.

The method by which food soil hydration system 100 is to be utilized will now be discussed in more detail. As depicted in FIG. 4, dishwasher 2 includes a control panel 160 including a display 162, a start/stop button 164, and a plurality of wash cycle selection buttons 165 in a manner known in the art. In accordance with the present invention, control panel 160 also includes a hydration selection button 166 shown having an associated LED indicator 170. Preferably, a drain indicator 174 is also included on control panel 160 to indicate to a user that a draining event is occurring.

Figure 5:
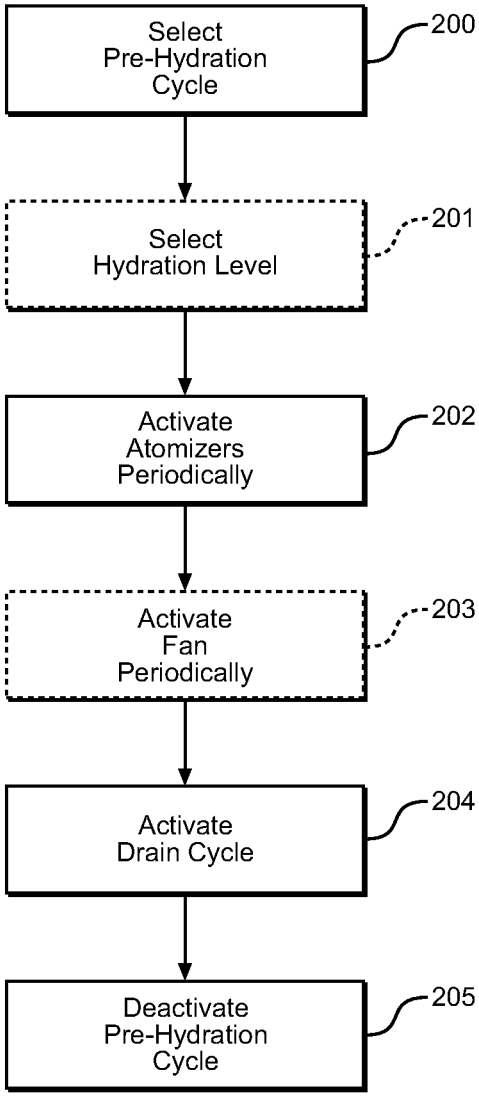
FIG. 5 is a flow chart depicting a preferred method for low temperature hydration of food soils in accordance with the present invention.

A user may wish to utilize food soil hydration system 100 when dishware within dishwasher 2 are particularly soiled to enhance the efficiency of a subsequent dishwashing cycle, or when there will be an extended period between washing cycles in order to prevent food soils from drying and becoming encrusted on the dishware. When a user wishes to actuate food hydration system 100, the user simply pushes hydration button 166 in a first step indicated at 200 in FIG. 5. Preferably, multiple hydration levels are available for selection by a user, as indicated at step 201. In accordance with one method, a user pushes hydration button 166 more than once, with each push of the button correlating with a selected time period between hydration cycles. For example, one push of hydration button 166 may select a time period of one hour between hydrations cycles, while two pushes of hydration button 166 selects a time period of two hours between hydration cycles. In accordance with another method, a user pushes hydration button 166 once to select a level of low hydration wherein less water is atomized by atomizers 108, and pushes hydration button 166 twice to select a level of high hydration wherein a greater amount of water is atomized by atomizers 108. Display 162 preferably indicates to a user the amount of hydration selected. It should be readily understood that other control arrangements could be employed, either in connection with control panel 160 or otherwise, to allow a user to select a desired amount of hydration, i.e., low hydration or high hydration, or the time period of hydration desired. In addition, periodic hydration could be automatically performed, such as whenever door 20 is closed and dishwasher 2 is not currently performing or has not recently completed a washing operation.

In any case, once a pre-hydration cycle is activated, atomizers 108 are actuated periodically, in accordance with the amount of hydration selected, until a washing cycle is initiated or the pre-hydration cycle is deactivated. For example, ultrasonic vibrators 109 and 110 may be actuated for a period of three minutes every hour as indicated at step 202. When a fan, such as fans 112, 146 and/or 147, is utilized, the fan is actuated during the same time period as atomizers 108, as indicated at step 203. After a predetermined actuation period, such as three minutes, has passed, atomizers 108 and any fan utilized (i.e. 112, 146 or 147) is deactivated. After a predetermined resting period has elapsed, such as one hour, the cycle is repeated. In instances where a high hydration level is selected or where dishwasher 2 has run through numerous hydration cycles, it may be necessary to drain water from tub 5 in a manner known in the art at step 204. In such a situation, a water sensor (not shown) is employed to instigate a water drain cycle when water reaches a certain level within tub 5, or tub 5 may drain after a predetermined time period based on, for instance, the amount of hydration selected or the number of hydration cycles that have occurred. The hydration cycle will continue until it is deactivated at step 205, such as by pushing hydration button 166 a predetermined number of times, starting a washing cycle or utilizing stop/start button 164.

Based on the above, it should be readily apparent that the soil hydration system of the present invention can be effectively employed to provide for the enhanced washing of dishware by assuring that any food soils on loaded dishware will not be permitted to dry and harden between washing cycles. Advantageously, the present invention provides energy savings by pre-hydrating food soils which could require numerous energy-consuming washing cycles to remove or otherwise be difficult to remove from dishware if allowed to dry and harden. Additionally, the present invention preferably does not require heating of the water, as heated water not only polymerizes certain foods, thus making cleaning more difficult, but also consumes significant amounts of energy. Further, by supplying atomizers 108 with water from dedicated water supply lines, only small amounts of water need be utilized between washing cycles. As set forth above, the system of the invention does not need dedicated pumps as the water pressure in the water supply is sufficient to generate atomized water. To actuate the misting, all that is needed is the very low energy to open a water valve, such as the solenoid valve. The low temperature hydration arrangement of the invention would be particularly useful as consumers turn on a dishwasher at the end of the day, thereby enabling a long presoak period to be followed by a standard cleaning cycle, the combination of which could actually take all night. Alternatively, the invention can be used to keep dishes moist at any time between cycles.

Although described with reference to preferred embodiments of the invention, it should be readily understood that various changes and/or modifications can be made to the invention without departing from the spirit thereof. For instance, although shown with reference to particular numbers and arrangements of atomizing devices, it should be understood that any desired number and configuration of atomizing devices could be utilized to effectively spray dishware within the washing chamber. For instance, the atomizers could be provided directly on one or more wash arms of the dishwasher, on side walls or even on the top of the washing chamber. In addition, the invention can be employed in various types of dishwashers, including drawer-type dishwashers. Furthermore, it should be understood that the manner in which a desired hydration cycle is established should not be considered as limited to the embodiments disclosed herein as a wide range of means could be employed, including both manual and preprogrammed arrangements, in connection with providing the periodic food soil hydration of the invention. In general, the invention is only intended to be limited by the scope of the following claims.

What is claimed is:

1. A method for hydrating food soils on soiled dishware, loaded in a washing chamber of a dishwasher, between washing cycles of the dishwasher comprising the steps of:

(a) supplying fluid from a fluid supply line to a fluid spraying device located in the washing chamber between washing cycles of the dishwasher without heating of the fluid;

(b) distributing the fluid, through the fluid spraying device and without heating, within the washing chamber to moisten food soils on the dishware between washing cycles; and (c) cutting off the supply of fluid to the fluid spraying device, wherein steps a-c are conducted separate from and between washing cycles of the dishwasher based on receiving a direct user control input for food soil hydration.

2. The method of claim 1, further comprising:

periodically repeating steps a-c multiple times prior to initiating the washing cycle for the dishware.

3. The method of claim 2, further comprising: selecting a time interval at which steps a-c are repeated.

4. The method of claim 2, further comprising: selecting a desired number of times steps a-c are repeated prior to initiating the washing cycle.

5. The method of claim 1, further comprising: supplying water from a main water supply for the dishwasher as the fluid, with the water being distributed, without being heated, to hydrate the food soils.

6. The method of claim 1, further comprising: employing an atomizing spray nozzle as the fluid spraying device.

7. The method of claim 1, further comprising: performing a draining operation after repeating steps a-c and before initiating the washing cycle.

8. A method for hydrating food soils on soiled dishware, loaded in a washing chamber of a dishwasher provided with a heating element, between washing cycles of the dishwasher comprising the steps of:

(a) supplying water from a water source to a spraying device located in the washing chamber between washing cycles of the dishwasher without heating of the water by the heating element;

(b) distributing the water, through the spraying device and without heating with the heating element, within the washing chamber to moisten food soils on the dishware; and (c) cutting off the supply of water to the spraying device, wherein steps a-c are conducted only when the dishwasher is not performing or has not recently completed a washing operation.

9. The method of claim 8, further comprising:

periodically repeating steps a-c multiple times prior to initiating a washing cycle for the dishware.

10. The method of claim 9, further comprising: selecting a time interval at which steps a-c are repeated.

11. The method of claim 9, further comprising: selecting a desired number of times steps a-c are repeated prior to initiating the washing cycle.

12. The method of claim 8, further comprising: supplying cold water as the water, with the water being distributed without being heated.

13. The method of claim 8, further comprising: employing an atomizing spray nozzle as the spraying device.

14. The method of claim 8, further comprising: performing a draining operation after repeating steps a-c and before initiating the washing cycle.

15. A dishwasher comprising:

a tub defining a washing chamber into which dishware having food soils to be cleaned during a washing cycle are loaded;

a heating element for heating washing fluid during the washing cycle;

at least one spray arm for directing washing fluid onto dishware in the washing chamber during the washing cycle; and a food soil hydration system for hydrating food soils on loaded dishware between washing cycles including:

a fluid spraying device positioned in the washing chamber;

a fluid supply fluidly connected to the fluid spraying device for supplying fluid from a fluid supply to the fluid spraying device without heating of the fluid by the heating element;

a valve for controlling a supply of fluid from the fluid supply to the fluid spraying device; and means for actuating a food soil hydration operation for the dishwasher wherein fluid from the fluid supply is delivered to the fluid spraying device, without being heated by the heating element, to prevent food soils on dishware loaded in the washing chamber from becoming dry and hard before initiation of the washing cycle.

16. The dishwasher of claim 15, further comprising: a fan adapted to distribute fluid from the fluid spraying device to the washing chamber.

17. The dishwasher of claim 15, wherein the fluid spraying device is an ultrasonic vibrator.

18. The dishwasher of claim 15, wherein the fluid spraying device is an atomizing spray nozzle.

19. The dishwasher of claim 15, wherein the fluid spraying device comprises a combination spray nozzle and fan, wherein the fan is adapted to atomize fluid sprayed by the spray nozzle.

20. The dishwasher of claim 15, wherein the fluid supply provides cold water to the fluid spraying device.

* * * * *